United States Patent [19]

Turkenkopf

[11] 3,955,749

[45] May 11, 1976

[54] EXPANSIBLE ENVELOPE

[76] Inventor: Eugene Turkenkopf, 1323 Taft Road, Teaneck, N.J. 07666

[22] Filed: June 28, 1974

[21] Appl. No.: 484,141

[52] U.S. Cl. ..... 229/61; 229/DIG. 3
[51] Int. Cl.[2] ..... B65D 31/10
[58] Field of Search ..... 229/61, 57, 58, DIG. 3

[56] References Cited

UNITED STATES PATENTS

| | | | |
|---|---|---|---|
| 2,832,433 | 4/1958 | Brace | 229/58 X |
| 3,552,640 | 1/1971 | Young | 229/61 |

FOREIGN PATENTS OR APPLICATIONS

| | | | |
|---|---|---|---|
| 835,328 | 12/1938 | France | 229/61 |

*Primary Examiner*—William Price
*Assistant Examiner*—Stephen P. Garbe
*Attorney, Agent, or Firm*—Kane, Dalsimer, Kane, Sullivan and Kurucz

[57] ABSTRACT

An expansible envelope container, folder, bag and the like formed from a one-piece unitary blank is provided. The envelope includes a front panel and rear panel separated by a bottom panel. Each of the front and rear panels has a flap extending outwardly from its left and right side edges. Each of these flaps includes an adhesive and an adhesive-free zone. The front and rear panel right side flaps are secured to each other and similarly the front and rear panel left side flaps are secured to each other. An integral blank for forming the envelope container, folder, bag and the like is also disclosed.

18 Claims, 13 Drawing Figures

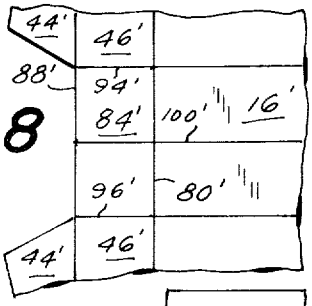
FIG. 8
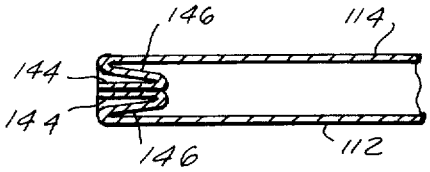
FIG. 10
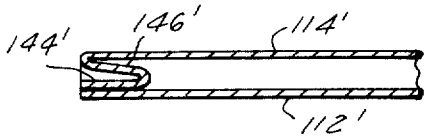
FIG. 11
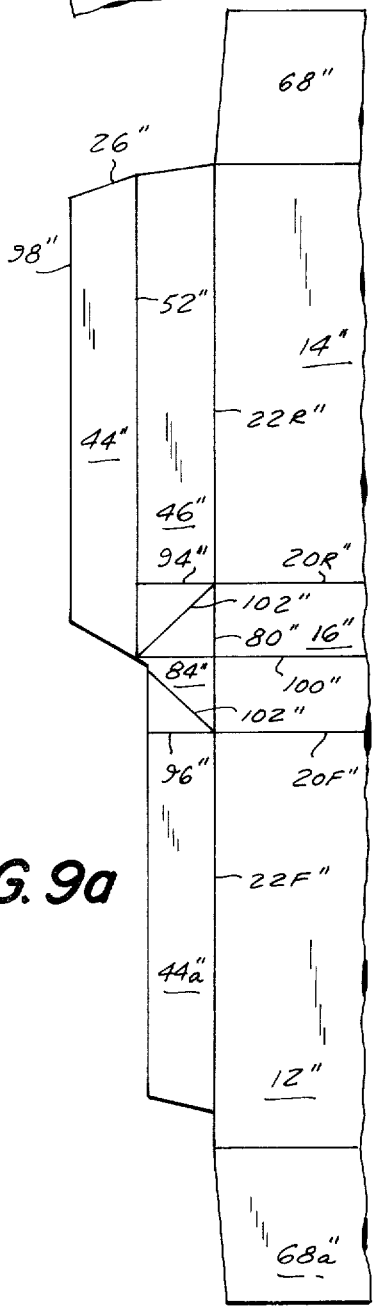
FIG. 9a
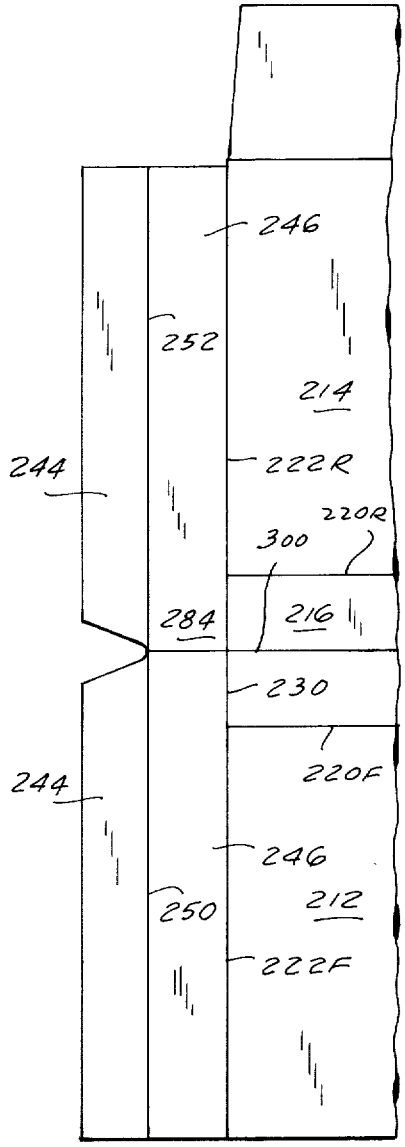
FIG. 12
FIG. 9b
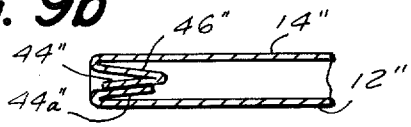

EXPANSIBLE ENVELOPE

BACKGROUND OF THE INVENTION

The present invention relates to an improved envelope container, folder, bag and the like (hereinafter simply referred to as an envelope) and in particular to an improved expansion envelope construction.

Expansion envelopes are extensively used in many fields. One of many common applications of such envelopes is as a prepaid mailer for film processing or the like. The envelopes can be stored and sent flat prior to use and then expanded during use sufficiently to receive and securely contain the contents therein.

Heretofore, several forms of expansible envelopes have been proposed as exemplified by U.S. Pat. Nos. 67,111; 442,842; 681,,472; 2,188,730; 2,281,452; 2,460,909; 3,414,185; and 3,552,640. In the main, in each case, the prior art envelope had a single glued seam extending down the middle of the front or rear panel.

The construction of this envelope lends itself to production on standard type equipment which normally runs at a greater productive speed than expandable envelopes now being manufactured. Unlike existing expansible envelopes this unit can be produced on standard machines, some of which automatically cut and patch a window.

In view of the above, it is the principal object of the present invention to provide an improved expansible envelope. A further object is to provide a unitary integral blank from which the envelope may be produced.

SUMMARY OF THE INVENTION

The above and other beneficial objects and advantages are attained by providing an expansible envelope formed from a one-piece unitary blank cut and folded to define a rear panel, a front panel and a bottom panel. A pair of right side flaps extend from and are coextensive with the right side edges of the front and rear panel and, similarly, a pair of left side flaps extend from and are coextensive with the left side edges of the front and rear panels. Each of the side flaps has an adhesive zone and a non-adhesive zone separated by a fold line. The right side flaps are secured to one another and the left side flaps are secured to one another.

The present invention also contemplates an envelope construction with several modifications of the basic envelope construction. Towards this end, the envelope bottom may be formed with or without an outwardly directed "V" and with and without gum or adhesive to respectively close or permit opening of the V when provided. The bottom may also be formed with or without scoring which when provided facilitates tucking away of the bottom fold-over to form a box. The gussets along the sides of the envelope may be either straight or tapered. The envelope may also be formed with or without bank-tail flaps and top side flaps for added security.

BRIEF DESCRIPTION OF THE DRAWINGS

In the accompanying drawings:

FIG. 8 is a fragmentary plan view showing another form of envelope bottom construction with the outwardly directed V eliminated;

Figure 1:
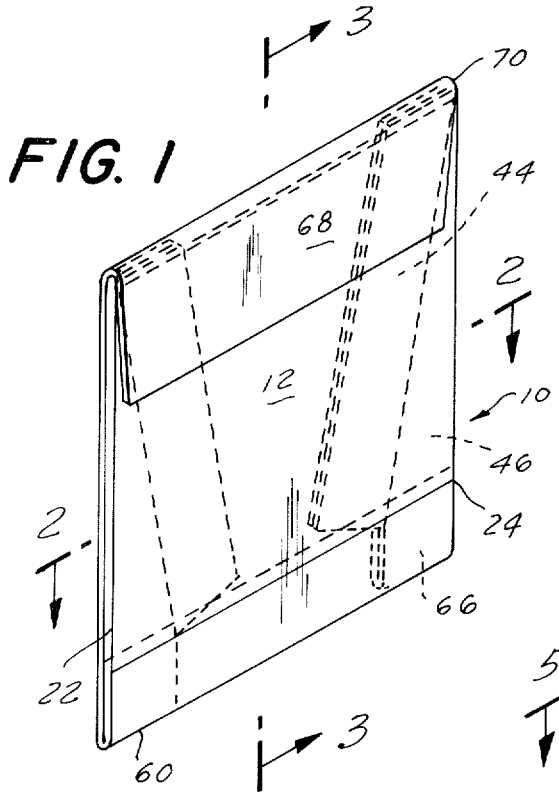
FIG. 1 is a perspective view of an expansible envelope in accordance with the present invention shown in a flat, unexpanded condition.

FIG. **9*a*** is a fragmentary plan view of an envelope construction with the side gussets straight or rectangular as distinct from tapered or triangular in the initially described embodiment;

FIG. **9*b*** is a fragmentary section showing manner of attachment of side flaps;

FIG. 10 is a cross-sectional view of another envelope construction showing a different manner of securing the side flaps;

FIG. 11 is a similar cross-sectional view of another side flap sealing arrangement; and FIG. 12 is a fragmentary plan view of yet another envelope construction contemplated by the present invention.

DETAILED DESCRIPTION

Reference is now made to the drawings wherein similar components bear the same reference numerals throughout the several views. The present envelope 10 comprises a generally rectangular front panel 12, a rear panel 14, and a bottom panel 16 extending between the front and rear panels. The front panel 12 is defined between a top edge 18, a bottom edge 20, a left side edge 22 and a right side edge 24. The rear panel 14 is similarly defined between top, bottom, right side and left side edges. As shown best in FIG. 1, the front and rear panels may be of equal size with the corresponding edges in registry with each other.

The left and right side edges 22 and 24 of the front panel and the corresponding edges of the rear panel are defined by fold lines which interconnect the front and rear panels with associated flaps. Accordingly, right side flap 26 is connected to front panel 12 along fold line 28. Similarly, right side flap 30 is connected to rear panel 14 along fold line 32; left side flap 34 is connected to front panel 12 along fold line 36; and left flap 38 is connected to rear panel 14 along fold line 40. Each of the flaps is divided by a flap fold line between an adhesive zone and an adhesive-free zone. Thus, flap fold line 42 separates the adhesive zone portion 44 from the adhesive-free zone portion or gusset 46 of flap 26. Similarly, flap fold lines 48, 50 and 52 respectively separate flaps 30, 34 and 38 into adhesive and adhesive-free zones or gussets. In each case, the adhesive zone extends from the free edge of the flap to the flap fold line and the adhesive-free zone extends from the flap fold line to the fold line separating the flap from its associated panel. Thus, for example, the adhesive zone of flap 26 extends from free edge 54 to the flap fold line 42 and the adhesive-free zone extends from the flap fold line 42 to fold line 28.

Bottom panel 16 is generally rectangular in shape and coextensive in width with the front and rear panel to which it is connected along fold lines 56 and 58.

That is, fold line 56 interconnects the bottom panel 16 with front panel 12 and fold line 58 interconnects the bottom panel with rear panel 14. Fold line 60 extends transversely across the bottom panel.

Figure 4:
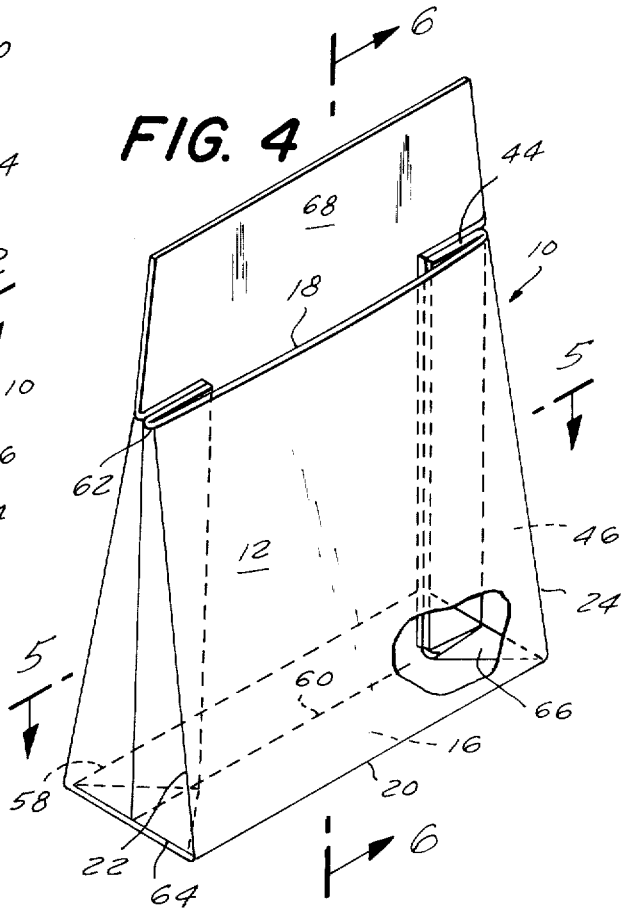
FIG. 4 is a perspective view similar to FIG. 1 depicting the envelope of the present invention in an expanded condition.
Figure 2:
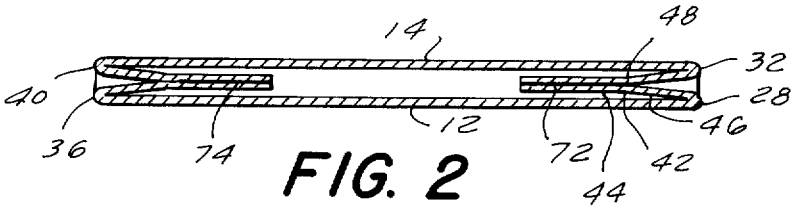
FIG. 2 is a sectional view taken along reference lines 2—2 of FIG. 1 in the direction indicated by the arrows.
Figure 5:
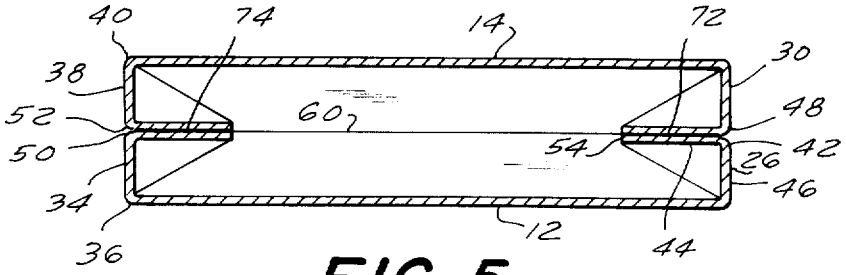
FIG. 5 is a sectional view taken along reference lines 5—5 of FIG. 4 in the direction indicated by the arrows.

As shown best in FIG. 4, each of the side flap adhesive-free portions is triangular in shape extending from an apex 62 at the top of the envelope to a base 64 defined by a fold line connecting the adhesive-free portion of the side flap with a bottom flap 66. The envelope, in the open condition shown in FIG. 4, thus expands at the bottom and remains narrow at the top even when opened. However, subsequent embodiments herein will show, that other than a triangular gusset is contemplated by this invention. A cover flap 68 is connected by fold line 70 to the top edge of rear panel 14.

The envelope is assembled by adhesively securing the adhesive zones of the side flaps on each side of the envelope to each other. Accordingly, zone 44 of flap 26 is secured to the corresponding zone of flap 30 by means of an interposed glue, 72 adhesive, bonding, heat sealing or other methods, the selected form of attachment 74 is used to secure the companion zones of left side flaps 34 and 38 to each other.

When the envelope is unexpanded, as shown in FIG. 1, both the adhesive and adhesive-free zones of each side flap is sandwiched between the front and rear panels. However, when the envelope is expanded, as shown in FIG. 4, while the adhesive zones remain within the interior of the envelope, the adhesive-free zones define the sides of the expanded envelope. In this regard, it should be noted that the width of the envelope of the discussed embodiment at the top remains flat even when the envelope is expanded since the adhesive-free zones taper to a point at the top. As will be evident this taper may be reversed or the gusset may be rectangular. At the bottom, the envelope expands to its full width since the adhesive-free zones are widest at the bottom. After the envelope is expanded and an object is placed therein, the envelope may be sealed for shipment or mailing by folding the top flap 68 over the front panel which can be accomplished without difficulty since the width of the envelope at the top edge remains about the same whether the envelope is expanded or not.

Figure 7:
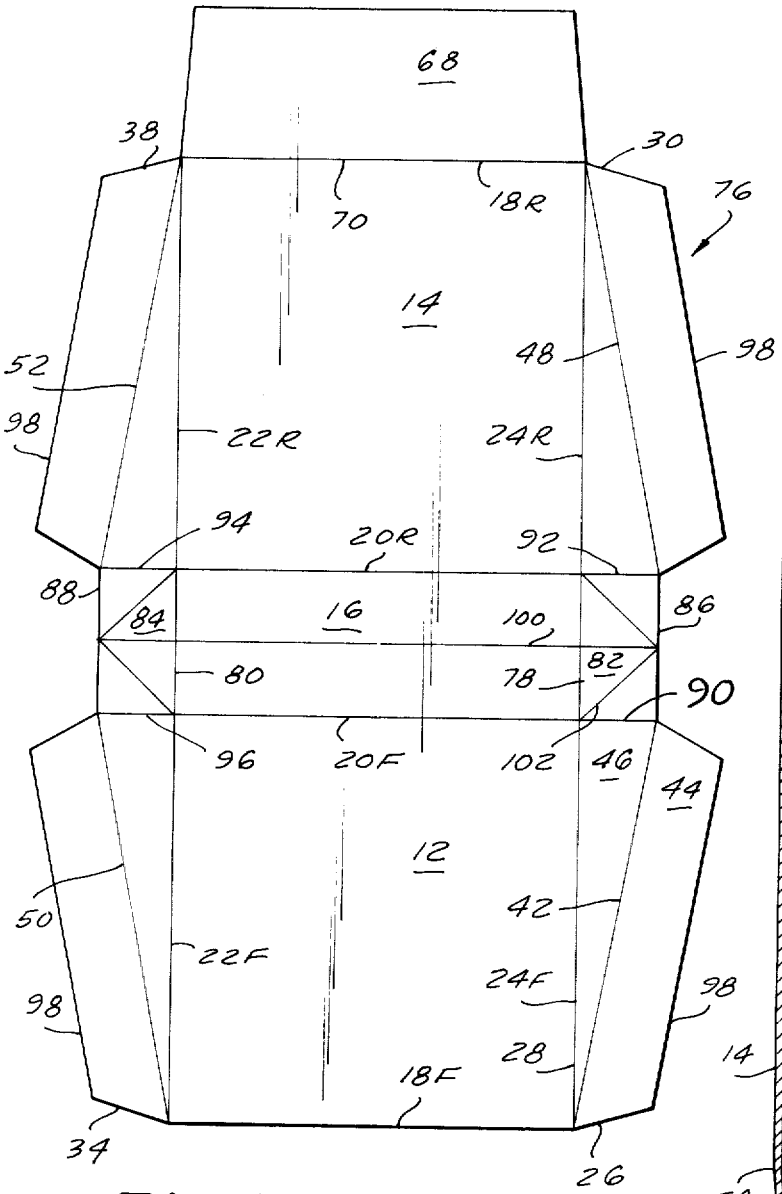
FIG. 7 is a plan view of a one-piece blank for forming the present envelope.
Figure 3:
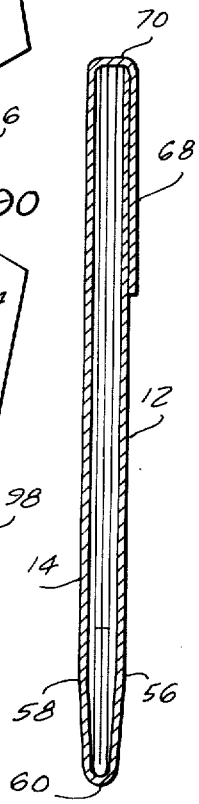
FIG. 3 is a sectional view taken along reference lines 3—3 of FIG. 1 in the direction indicated by the arrows.
Figure 6:
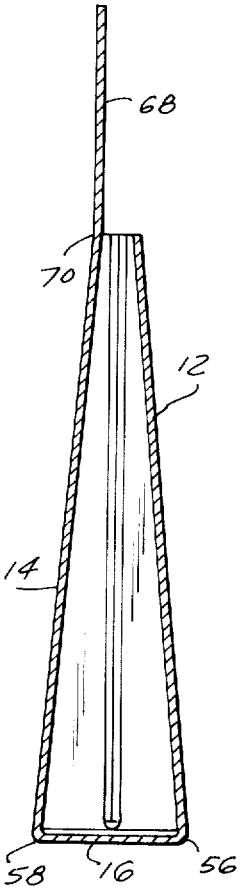
FIG. 6 is a sectional view taken along reference lines 6—6 of FIG. 4 in the direction indicated by the arrows.

The expansion envelope of the present invention may conveniently be formed from a unitary integral blank 76 as shown in FIG. 7. In order to simplify the following discussion of blank 76, where possible, the same reference numerals will be applied to the various parts of the blank as were used in the previous description of the assembled envelope. Accordingly, the blank 76 comprises a generally rectangular rear panel 14 having longitudinally spaced top and bottom edges 18R and 20R and transversely spaced left and right side edges 22R and 24R. Bottom edge 20R is defined by a fold line which separates the rear panel 14 from bottom panel 16.

Bottom panel 16 is generally rectangular and coextensive in width with the rear panel. The bottom panel is defined between a pair of spaced, longitudinal edges (20R and 20F) and transversely spaced right and left edges 78 and 80. As previously stated, the bottom edge 20R of rear panel 14 is defined by a fold line which also defines one of the longitudinally spaced edges of bottom panel 16. The other longitudinally spaced edge 20F is defined by a fold line which joins the bottom panel 16 with front panel 12. Front panel 12 is substantially identical with rear panel 14 and, accordingly, is defined by the longitudinally spaced edges 20F and 18F and left and right side edges 22F and 24F. The side edges of each of the front and rear panels is defined by a fold line joining that side edge with a flap. Accordingly, front side edge 24F is defined by fold line 28 joining the front panel with flap 26. Similarly, flap 30 is joined to rear panel 14 by a fold line defining rear panel right side edge 24R; flap 34 extends from the left side edge 22F of front panel 12; and flap 38 extends from the left side edge of rear panel 14.

Each of the flaps 26, 30, 34 and 38 is divided into two portions by an associated flap fold line. Thus, flap fold line 42 separates flap 26 into an adhesive-free zone 46 and an adhesive zone 44. Similarly, flap fold line 48 divides flap 30 into two zones; flap fold line 50 divides flap 34 into two zones and flap fold line 52 divides flap 38 into two zones.

Right and left bottom flaps 82 and 84 respectively extend from the right and left edges of bottom panel 16 and are joined to the bottom panels by fold lines defining the edges 78 and 80. Bottom flap 82 extends to free edge 86 and bottom flap 84 extends to free edge 88. Bottom flaps 82 and 84 are each joined by a fold line forming an extension of fold lines 20F or 20R to a side flap portion. Accordingly, flap 82 is joined to portion 46 of flap 26 by fold line 90 and similarly, fold line 92 joins flap 82 with portions of flap 30; fold line 94 joins flap 84 with portions of flap 38 and fold line 96 joins portions of flap 34 with flap 84.

As shown in FIG. 7, each of the flap fold lines 42, 48, 50 and 52 extends from the intersection of its associated front and side edges to the free edge of the associated bottom flap. Thus, flap fold line 42 extends from the intersection of top edge 18F and side edge 24F to the intersection of fold line 90 and free edge 86. The free edges 98 of the side flaps extend parallel to the associated flap fold lines, as shown.

The present blank further includes a top panel 68 extending from the top edge 18R of rear panel 14 along fold line 70 which coomprises the top edge 18R. Also, as shown in FIG. 7, a fold line 100 extends transversely across the center of bottom panel 16 and its associated flaps from free edge 86 to free edge 88 thus dividing each of the flaps 82 and 84 in half. Each of the so divided bottom-flaps is further divided by a diagonal fold line 102 extending between (a) the intersection of fold line 100 and the free edge (86 or 88) and (b) the intersection of a bottom panel side edge (78 or 80) and the longitudinally spaced edges 20R and 20F of the bottom panel.

In the modified envelope bottom construction of the embodiment of FIG. 8, the triangular gusset 46 is altered in shape and the fold lines 102 are eliminated. Thus any other shaped gusset 46 as for example rectangular may be employed. In all other respects the envelope and blank of this embodiment are similar to that of the previous embodiment and like parts will be similarly numbered with an accompanying prime.

In FIG. 9, the illustrated embodiment may include a bag bottom of either of the previously desribed embodiments, but contemplates an alternate form of envelope side. As in the previous embodiment like parts will be similarly numbered with an accompanying double prime. In this embodiment only one rectangularly shaped gusset 46'' is provided to which is hingedly secured along fold line 52'' the adhesive zone or panel 44''. This adhesive panel 44'' is adapted to be secured to the adhesive panel A'' which extends from the front panel 12'' with the fold line 22F'' interposed therebetween. A flap 68*a* may be provided in addition to the top flap 68'' for added security with the top flap 68'' provided with adhesive and any other form of attachment to the outer face of the front panel 12''.

In the embodiment of FIG. 10 the envelope blank may be essentially that shown in FIG. 8 but the manner of securing the panels 144 may be different. Towards this end, the attaching of the panels 144 in the manner shown permits heat sealing of these panels to be employed. In all other respects the parts of this embodiment are the same and like parts will be similarly numbered but increased by a factor of one hundred.

Another embodiment that lends itself to heat sealing of the envelope sides is illustrated in FIG. 11. This embodiment is somewhat similar to the previous embodiment of FIG. 10, with the exception that one side gusset and accompanying sealing panel are eliminated. As will be evident the gusset 146' is rectangular and its companion panel 144' is sealed to the inner face of the front panel 112'.

In FIG. 12 another embodiment is disclosed and parts resembling that of the initial embodiment will bear similar numbers increased by a factor of 200. In most material respects this embodiment differs by eliminating the fold lines 294, 296 and 202. The gussets 246 are rectangular in configuration and the companion panels 244 are secured to one another similar to that shown in FIGS. 1–7.

In accordance with the above, the aforementioned objects and advantages may effectively be attained. In the above, only one embodiment of the present invention has been described. It should be understood, however, that the present invention is not limited to the single embodiment but rather by the scope of the following claims.

What is claimed is:

1. An expansible envelope for shipment, sending or mailing items and being formed from a one-piece unitary blank cut and folded into a substantially flat condition to define:

a. a rear panel having a top edge, a bottom edge, a right side edge and a left side edge;

b. a front panel overlying said rear panel and having a top edge, a bottom edge, a right side edge and a left side edge, the dimension between the right side edge and left side edge at substantially any location on the front panel being essentially the same as the dimension between the right side edge and left side edge at a corresponding location on the rear panel;

c. a bottom panel extending between and integral with each of said front and rear panel bottom edges, the bottom panel being free of any adhesive to permit the substantially flat envelope to be expanded;

d. right side flap means extending outwardly from one of said right side edges;

e. left side flap means extending outwardly from one of said left side edges;

f. right securing means securing portions of said right side flap means to the other of said right side edges;

g. left securing means securing portions of said left side flap means to the other of said left side edges;

h. the substantially flat envelope adapted to be expanded such that the bottom panel and flap means extend laterally from and are interposed between the front and rear panel to define a compartment therebetween, said compartment having an opening between said top edges and all of said flap means and said securing means being disposed intermediate one of said top edges and said bottom panel in expanded condition of the envelope;

i. a cover flap extending from said one top edge, said cover flap being foldable over the other top edge to thereby overlie said opening; and j. said cover flap adapted to be secured in a position in which said cover flap overlies said opening.

2. The envelope in accordance with claim 1, wherein each of said right and left side flap means includes a zone defining a gusset free of said securing means extending from the associated front or rear panel side edge.

3. The invention in accordance with claim 2, wherein each of said gussets is generally rectangular in shape with one side thereof being defined by a front or rear panel side edge.

4. The envelope in accordance with claim 2, wherein each of said gussets is generally triangular in shape, and each of said triangles is defined on one side by a front or rear panel side edge.

5. The envelope in accordance with claim 4, wherein each of said triangles comprises a right triangle having one leg defined by one side edge of one of said front or rear panels, the other leg defined by an extension of the bottom edge of said one panel, and a hypotenuse extending to the intersection of said one panel top edge and one side edge.

6. The envelope in accordance with claim 1, further comprising a first fold line extending across the center of said bottom panel parallel to said front and rear panel bottom edges.

7. The invention in accordance with claim 6, wherein further fold lines extend parallel to said first fold line and one on each side thereof defined by the front and rear panel bottom edges defining the juncture between the bottom panel and the respective front and rear panels.

8. The invention in accordance with claim 1, wherein side flap means extends from each of the side edges of the front and rear panels, each of said side flap means is defined by two zones, the outermost zone bearing the securing means and the inner interposed zone defining a gusset for facilitating the expansion of the envelope, the right and left securing means of the respective right and left side flap means of the front panel being secured with the respective right and left securing means of the right and left flap means of the rear panel respectively.

9. The invention in accordance with claim 8, wherein the securing means of each of the flap means defines a fold line with the adjacent gusset, the securing means being disposed inwardly of such fold line and the adjacent side edges of the front and rear panels.

10. The invention in accordance with claim 8, wherein the securing means of each of the flap means defines a fold line with the adjacent gusset, the securing means being disposed outwardly of such fold line and being in overlying relationship with the adjacent gusset.

11. The invention in accordance with claim 1, wherein the side flap means extend from only one of said front and rear panels, each flap means including a substantially rectangular gusset defining a fold line with the associated side edge and the securing means defining a fold line with the adjacent gusset and being secured with the innerface of the other panel along the side edge of such panel.

12. The invention in accordance with claim 1, wherein the side flap means extend from only one of said front and rear panels, each flap means including a substantially rectangular gusset defining a fold line with the associated side edge and the securing means defining a fold line with the adjacent gusset and being secured with the other panel along the side edge of such panel.

13. The invention in accordance with claim 12, wherein the flap means extends from each side of the rear panel.

14. The invention in accordance with claim 13, wherein a flap means extends from each side of the front panel and defines a fold line with the associated side edge, each of the fold means being folded inwardly for disposition between the front and rear panels and the securing means being folded outwardly about its adjacent fold line, and the securing means being secured to the flap means of the front panel.

15. The invention in accordance with claim 1, wherein the bottom panel includes a right side edge and a left side edge and further comprising a bottom panel right flap jointed by a right bottom fold line to said bottom panel right side edge and bottom panel left flap means joined by a left bottom fold line to said bottom panel left side edge, each of said bottom panel flaps extending from their associated fold lines to a free edge, when the envelope is in a substantially flat condition, the bottom panel right and left flap being disposed inwardly of the bottom panel right and left side edge, and when the envelope is expanded, the bottom panel right and left flaps are adapted to be superimposed on the bottom panel adjacent the bottom panel right and left side edges, respectively.

16. The invention in accordance with claim 15, wherein a first fold line extends across the center of said bottom panel parallel to said front and rear panel bottom edges.

17. The invention in accordance with claim 16, wherein first score lines extend parallel to said first fold line and one on each side thereof defined by the front and rear panel bottom edges defining the juncture between the bottom panel and the respective front and rear panels.

18. The invention in accordance with claim 17, wherein diagonal score lines extend from the intersection of the first score lines and the right and left bottom fold lines to the termination of the first fold line at the bottom right and left side.

* * * * *